US006082660A

United States Patent [19]

Meyer

[11] Patent Number: 6,082,660

[45] Date of Patent: Jul. 4, 2000

[54] SEPARATING DEVICE FOR WINDING DEVICES FOR MATERIAL WEBS, LONGITUDINALLY DIVIDED INTO SEVERAL PARTIAL WEBS

[75] Inventor: Gero Meyer, Untere Breite, Germany

[73] Assignee: Beloit Technologies, Inc., Wilmington, Del.

[21] Appl. No.: 08/952,622

[22] PCT Filed: Jun. 14, 1996

[86] PCT No.: PCT/EP96/02563

§ 371 Date: Nov. 20, 1997

§ 102(e) Date: Nov. 20, 1997

[87] PCT Pub. No.: WO97/00222

PCT Pub. Date: Jan. 3, 1997

[51] Int. Cl.[7] ..... B65H 23/00; B65H 57/14

[52] U.S. Cl. ..... 242/548; 242/615.21; 242/615.4

[58] Field of Search ..... 242/548, 615.2, 242/615.4, 615.21

[56] References Cited

U.S. PATENT DOCUMENTS

| | | | |
|---|---|---|---|
| 3,463,377 | 8/1969 | Lucas | 226/197 |
| 3,719,316 | 3/1973 | Frye | 226/199 |
| 3,765,616 | 10/1973 | Hutzenlaub et al. | 242/56.5 |
| 3,786,975 | 1/1974 | Heymanns | 226/194 |
| 4,410,122 | 10/1983 | Frye et al. | 242/615.2 |

FOREIGN PATENT DOCUMENTS

| | | |
|---|---|---|
| 0 431 275 | 10/1990 | European Pat. Off. . |
| 10 56 571 | 5/1959 | Germany . |
| 20 07 569 | 2/1970 | Germany . |

*Primary Examiner*—John Q. Nguyen

*Attorney, Agent, or Firm*—Raymond W. Campbell; Gerald A. Mathews

[57] ABSTRACT

A separating device for winding devices for material webs, particularly of paper or the like, which are longitudinally divided into several partial webs, with at least two rolls (1, 2) being essentially parallel to each other and flexed, or bowed, essentially in the same direction, with a stand (10) for the pivotable arrangement of the rolls about a common swivelling axis, with a support frame (9) for the rotatable mounting arrangement of the rolls about their respective axis of rotation and for the horizontal sweep of the rolls with respect to the stand (10) about the common swivelling axis, whereby at least one transmission pair (3, 5, 8; 8, 6, 4) for the simultaneous, automatic angular movement of the deflection line of the flexed rolls during the turning about a horizontal axis of the support frame with respect to the stand is provided in such a way, that the transmissions, or angular movement of the deflection lines, all the two rolls (1, 2) are necessarily operated by the turning movement. The basic concept is that through a turning the support frame of the two rotary web spreaders, or stretchers, the arc alignment of the rotary stretchers is necessarily adjusted with respect to the entering or exiting web. Thereby, any type of subsequent alignment of the arcs of the rotary web stretchers in the separating device to maintain the several partial webs in the predetermined spread-apart distance is completely eliminated.

5 Claims, 4 Drawing Sheets

30
B1
100
30''
1
30'
B2
Heff
21
31
2
22
G'
G''
31''
32
31'
33

90°
100
32
A
1
30
21
7
9
3B
34
5B
B
2
8B
22
90°
10

32
90°
30
100
A
1
7
21
9
2
B
45°
34
3B
5B
22
8B
90°

10

SEPARATING DEVICE FOR WINDING DEVICES FOR MATERIAL WEBS, LONGITUDINALLY DIVIDED INTO SEVERAL PARTIAL WEBS

BACKGROUND OF THE INVENTION

1. Field of the Invention

The invention relates to a separating device for winding devices for material webs, longitudinally divided into several partial webs, particularly those made of paper or the like.

2. Description of the Prior Art

In order to improve the web separation in so-called reel cutters after the cutting station, it is known to use so-called duo roll spreaders. Here, as a rule, two conventional so-called rotary stretchers are involved, i.e., rolls whose axis (and hence also their surface) is curved. The height of the arc, i.e., the radius of the deflection line, is adjusted to the particular application. Both rotary stretchers (also several rotary stretchers are possible) are arranged essentially parallel to each other and the planes spanned by the deflection lines are arranged essentially parallel to each other for the purpose of archieving a flawless functioning. Additional conditions for a flawless functioning are that the planes, spanned by the deflection lines, are always at a right angle to the entering or exiting web and the arcs, formed by the rotary stretchers, point in the same direction.

The extent of the total separation of all partial webs that can be achieved is a constant value for the respective initial situation. Thus, with an increasing number of partial webs, the spacing gaps that are realizable between them in a certain initial situation become increasingly smaller. For the rest, the extent of the achievable separation—on the one hand—depends on the radius of the deflection line of the rotary stretchers. The greater the deflection, i.e., the smaller the deflection radius, the greater the separation. On the other hand, the extent of the separation depends on how far (in the case of a constant axial distance of the two rotary stretchers) the web entering the separating device is distanced from the web exiting the separating device perpendicular to the direction of advance of the web. The greater this distance measure, described as the effective height ($=H_{eff}$) , the greater the separation.

Depending on the total width of the web that has been longitudinally separated into partial webs, and, depending on the number of partial webs and possibly on additional parameters, it is necessary, from case to case, to change the dimension of the separation. Since the deflection of the rotary stretchers can be changed only with great effort, it is customary to change the effective height by pivoting the two rotary stretchers about the common pivot point. In order to meet the condition of rectangularity between the arcs of the rotary stretcher and the entering or exiting web, the alignment of these arcs with respect to the entering web, on the one hand, and the exiting web, on the other hand, must be changed during a sweep of the two rotary stretchers by means of subsequent adjustment. This is time-consuming and labor-intensive, since the rotary stretchers inside the machine are often difficult to access.

DE-B-200 75 69 discloses a separating device having at all four rolls, two of which are revolving rolls borne in a tiltable boom frame, two of which are flexed rolls borne in a swivelling cross of swivelling arms. The swivelling axis of the swivelling cross must be exactly in the middle between the axis of the revolving rolls, therefore the ends of the boom frame are stationary coupled with the revolving rolls. The amount of web separation is changed by altering the wrapping angle of a web around the flexed rolls. Maximal separation is achieved with a wrapping angle of 90°. Therefore, the axis of one revolving roll is coupled with a corresponding flexed roll by alining arms with fork-shaped guidings.

A generic separating device is known from EP 0 431 275 A2 comprising a regulation mechanism which is fitted to correct the directional angles between the rolls and the web to desired values, preferably 90°, by means of rods being pitovable around their endportions and a swing mechanism, which is fitted to act upon the rolls to alter the deflection angles of the webs.

SUMMARY OF THE INVENTION

Based on this, it is the objective of the invention to render the subsequent adjustment of the arcs, such as in a generic separating device, avoidable. The objective is accomplished by a separating device comprising a pair of bowed rolls mounted on opposite sides of a pivoted support frame. Each bowed roll is mounted to a means, such as a lever or gear wheel, which in turn is linked to the support frame and stand via some means, such as an axially adjustable slide rod or gear wheel, which moves relative to the support frame, but not the stand, so as to maintain the positions of each bowed roll as desired. The invention is based on the basic concept that through a sweep of the support frame (i.e., pivotable movement about an axis parallel with the plane of the web surface) of the two rotary stretchers (i.e., bowed rolls), the arc alignment of the rotary stretchers is necessarily adjusted with respect to the entering or exiting web. Thereby, any type of subsequent alignment of the arcs of the rotary stretchers in the separating device is completely eliminated.

Advantageous embodiments of the subject matter of the invention, assuring in particular a simple layout of the arc adjustment transmissions, are shown in the Figures and described in the description of the preferred embodiments.

The structural components which are mentioned above, as well as those claimed in the examples, which are to be used in accordance with the invention, are not subject to special exceptional conditions with respect to their size, form, material selection and technical conception, so that the selection criteria known in the respective area of application can find unlimited application.

Further details, characteristics and advantages of the subject matter of the invention are apparent from the subsequent description of the accompanying drawings in which—for example—three preferred embodiments of a separating device of the invention are shown.

DESCRIPTION OF THE PREFERRED EMBODIMENT

Figure 1:
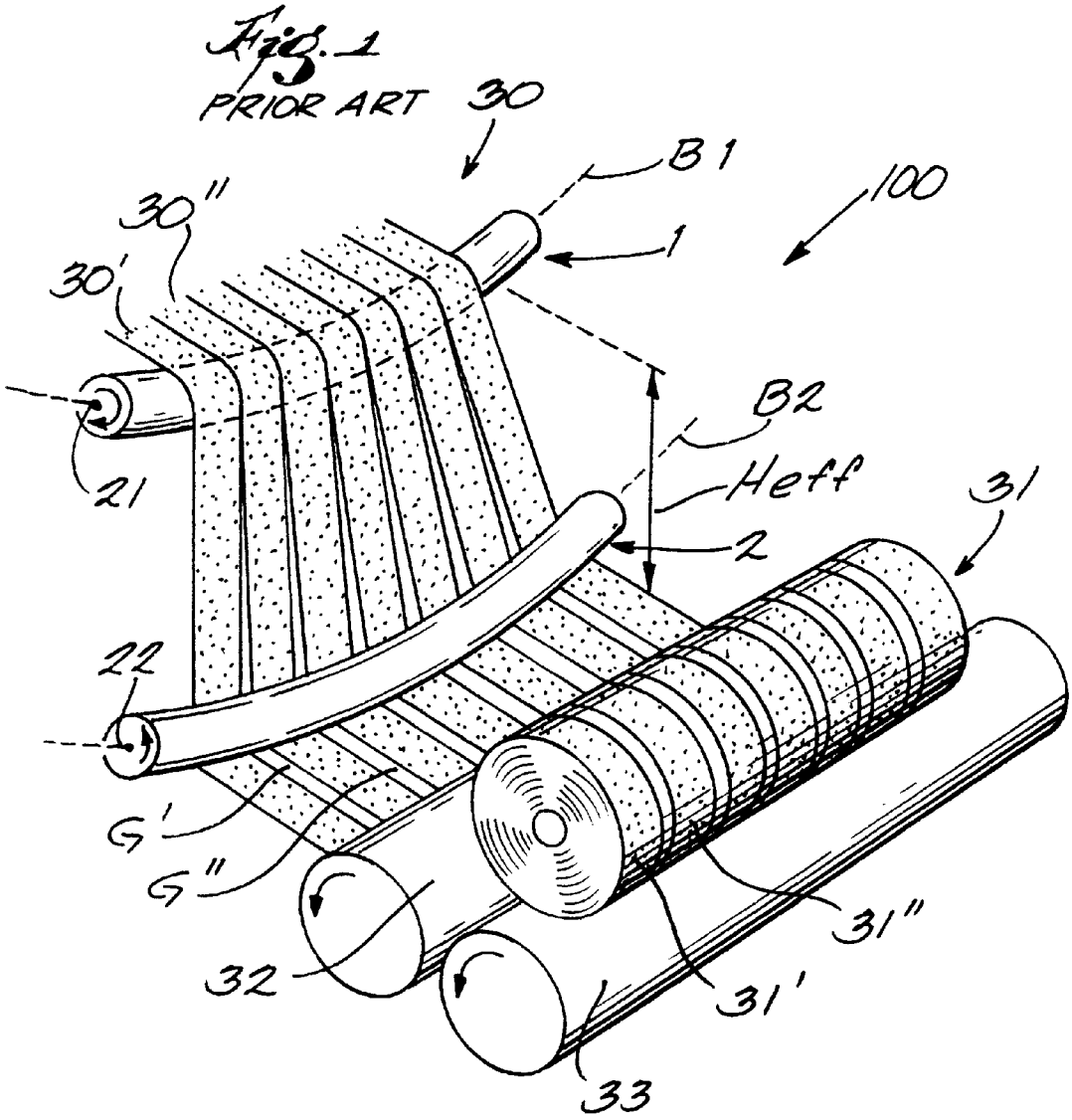
Fig. 1 PRIOR ART
FIG. 1 shows a perspective basic representation of a generic, prior art, separating device.

As can best be seen by means of FIG. 1, in all three embodiments according to the FIGS. 2A to 4B, respectively, two rolls 1, 2, forming a roll pair, are arranged with axial alignment parallel to one another in a support frame 9. The rolls 1, 2 are rotatably mounted in the support frame 9 in a manner wherein they can be freely turned or driven about their respective axes of rotation 21 or 22. Both roll axes are bowed with essentially the same deflection radius. The deflection lines of the axes of rotation 21 and 22 are indicated in FIG. 1 with B1 and B2, respectively. Both deflection lines—described in the subsequent text also as arcs—span a plane, wherein the plane, spanned by the arc B1, is aligned at a right angle with respect to the entering web and the plane, spanned by the arc B2 is at a right angle to the exiting web. The material web 30, guided between both rolls 1 and 2, is longitudinally divided into partial webs 30', 30". . . . While the entering partial webs (respectively on the left of the illustration) extend side-by-side particularly in a gapless manner parallel to each other, the exiting partial webs are distanced from each other by means of mutual spacing gaps G', G", . . . and in turn extend parallel to each other. Due to the fact that the entering partial webs are guided across the inner arc of the roll 1, the partial webs between the rolls 1 and 2 do not extend in a parallel arrangement, but in a fanned out configuration. Due to the fact that they are guided along the roll 2 around its outer arc, the obtained spread dimension (or separating dimension) is frozen, so to speak, since the exiting partial webs are again aligned parallel to each other and subsequently can be rolled into rolls 31, i.e., partial rolls 31', 31", . . . on any desired winding device. Merely as an example, in FIG. 1, a so-called double king roll winding device is shown, wherein the partial webs 30', 30", . . . are guided between the two driven king rolls 32 and 33. At that time, they wrap around the first entering king roll 32 and are rolled up in the winding bed present between the parallel king rolls 32 and 33 into the rolls 31', 31", . . . .

In order to be able to change the spacing gaps G', G", . . . in accordance with the total width of the material web 30 and depending on the number of partial webs 30', 30". . . created therefrom, or dependent on other factors, the effective height, i.e., the lateral displacement between the partial webs, which enter a separating device, indicated in total with number 100, is changed with respect to the webs extending parallel thereto. This is explained in detail by means of the subsequent description of the FIGS. 2A to 4B:

In the embodiments of the invention, the separating device 100 for winding devices for material webs 30, that are longitudinally divided into several partial webs, as represented in the examples, has two rolls 1 and 2 of a roll pair 1, 2, which are flexed essentially in the same direction. The rolls 1 and 2 are rotatably arranged with spherical bearings in a support frame 9 such that the roll surface can be rotated about the respective axis of rotation 21 or 22 either freely or possibly in a driven manner. The crown of the arcs of the two rolls 1 and 2, which is indicated in the drawing by means of the associated radius vector A or B, does not change its direction in space during the rotation of the roll surface about the respective axis 21 or 22. Thus, the directions of the vectors A and B are stationary, as long as no special adjustment is undertaken. The support frame 9, carrying the two rolls 1 and 2 in a rotatable manner, can be pivoted on a stand 10 or a pair of stands about a central swivelling axis 7 which extends parallel to the rolls 1 and 2. The rotatably arranged support frame, located at the other front face which is opposite the observer, is shown while the support frame, which is near the observer, has been omitted in order to provide an unobstructed view of the transmission near the observer.

Figure 2A:
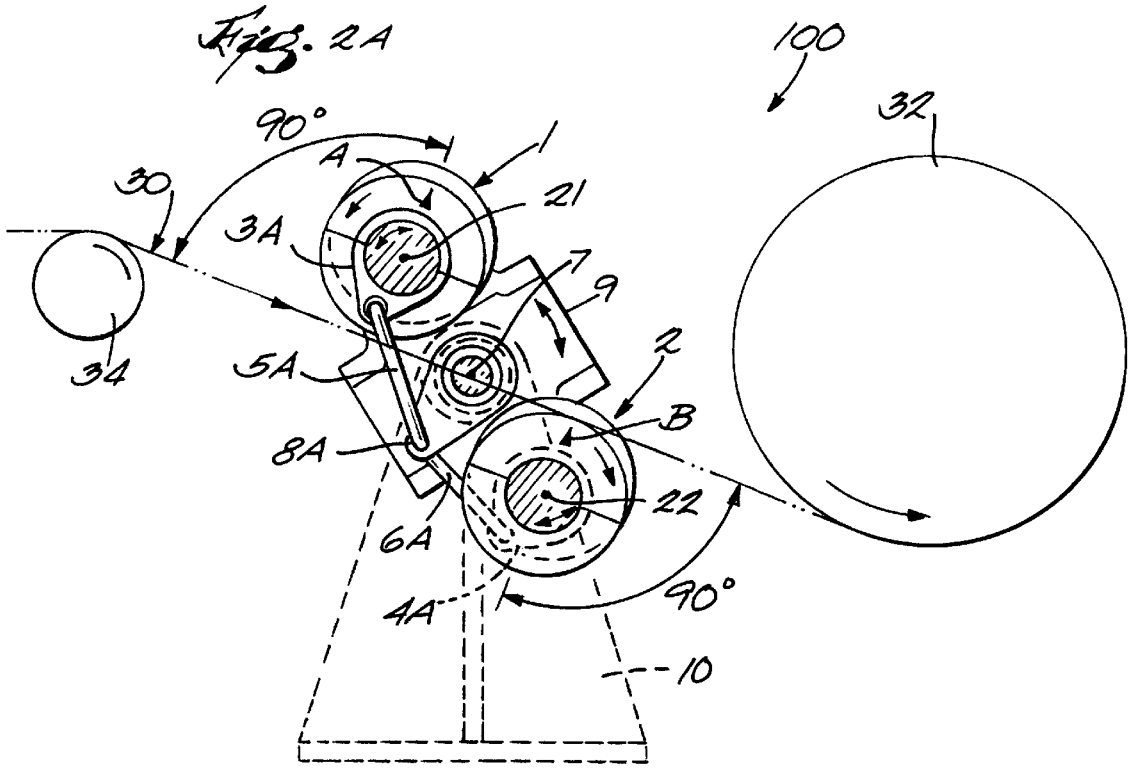
FIG. 2A/B shows a first embodiment of the invention in different operating positions of the separating device in frontal view (schematic)
Figure 2B:
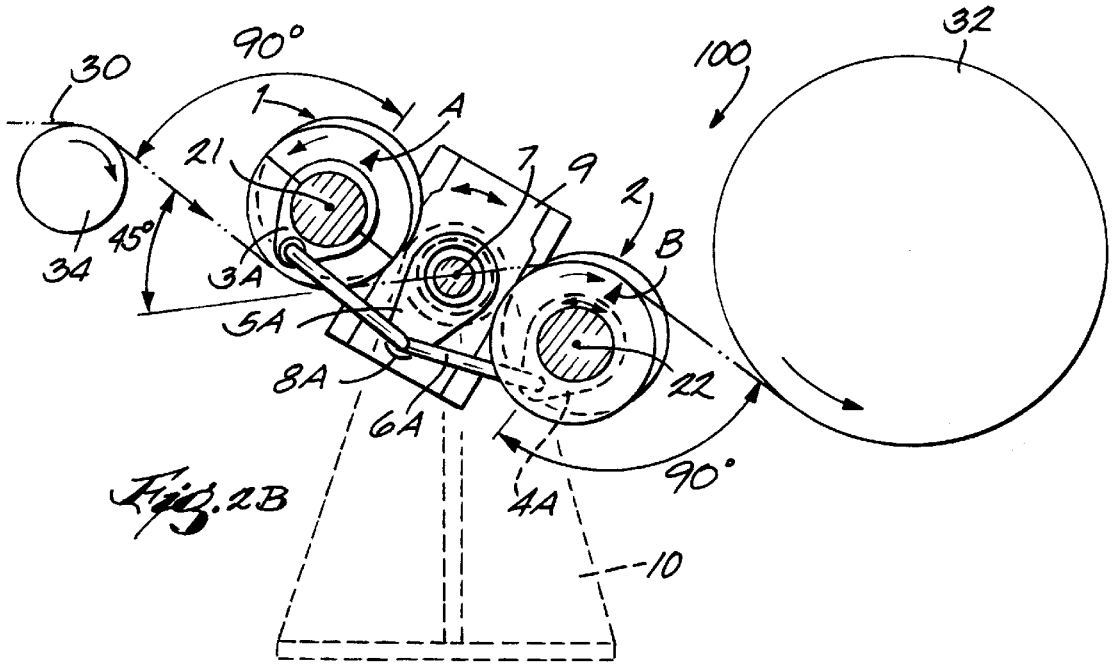
Figure 3A:
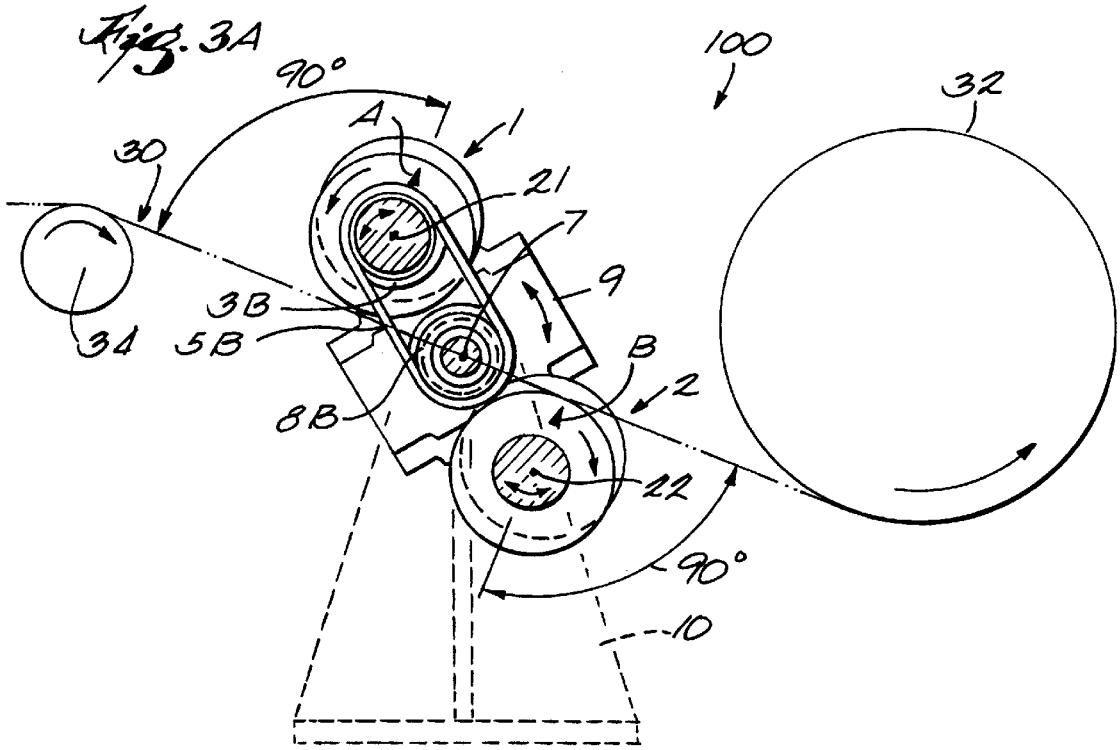
FIG. 3A/B shows a second embodiment of the invention in the same type of representation and FIG. 4A/B shows a third embodiment of the invention in the same type of representation.
Figure 3B:
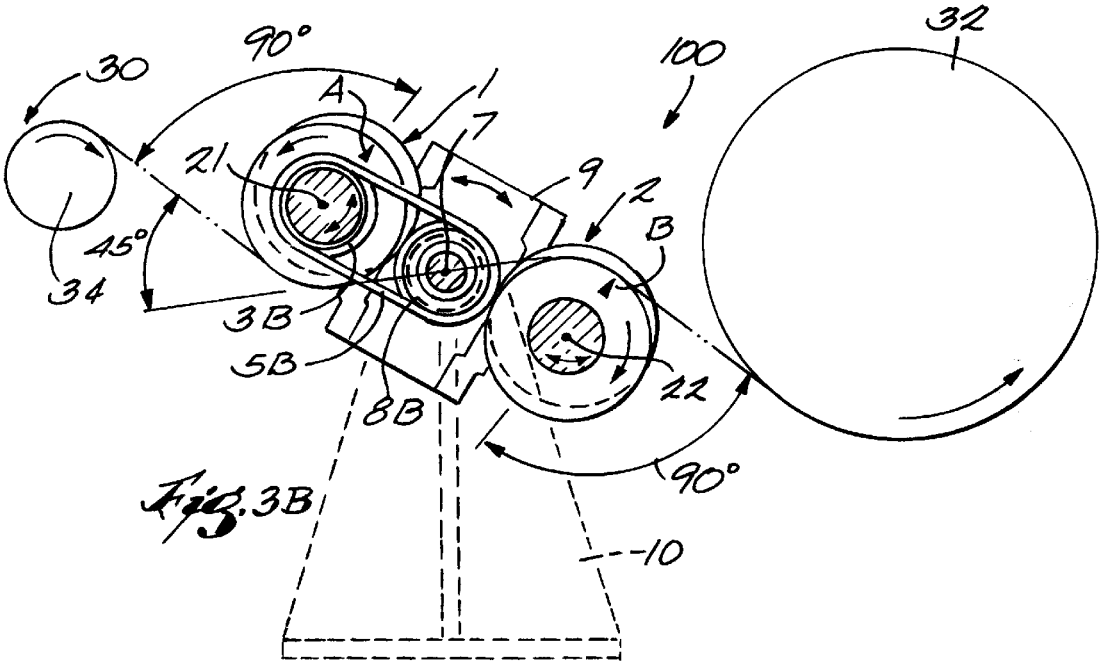
Figure 4B:
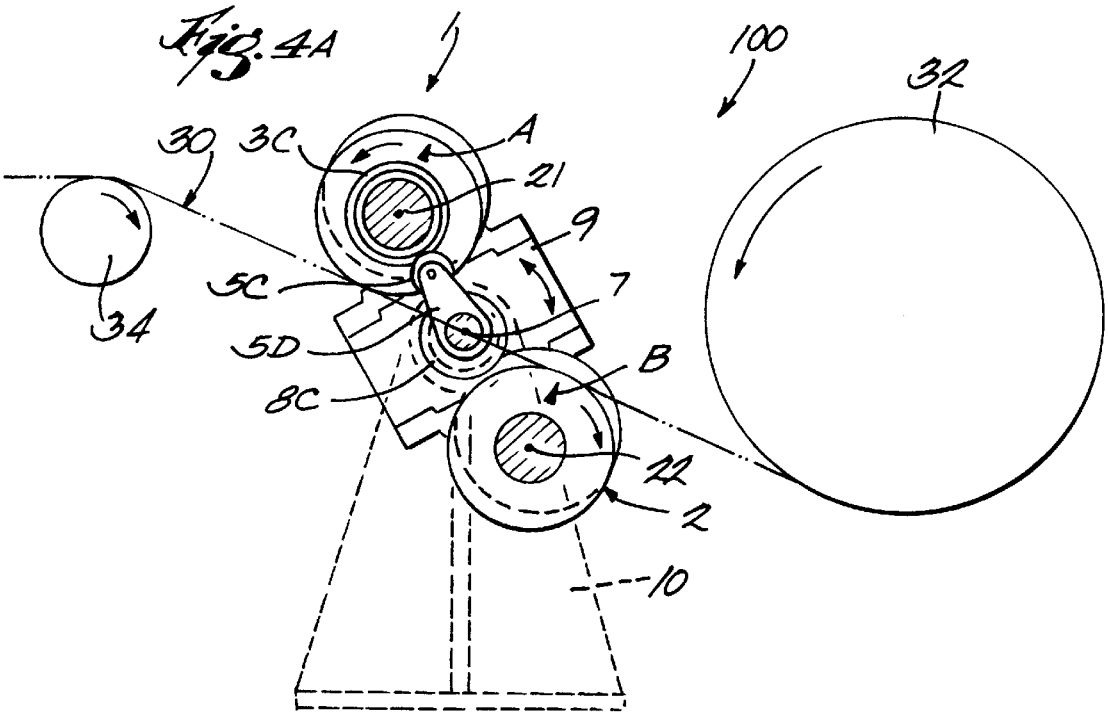
Figure 4B:
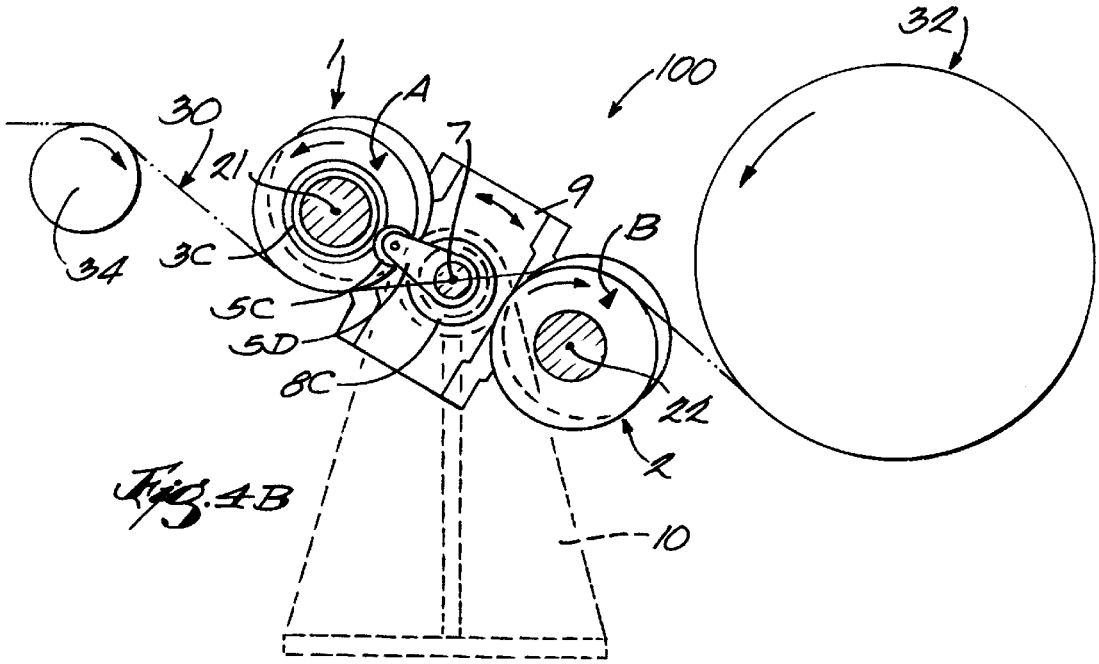

With the operating positions shown in FIGS. 2A, 3A and 4A, the material webs 30 extend in a straight line between a roll 34, arranged in the inlet area, and a roll 32 assigned to the outlet area. The entering web touches the roll 1 merely at the two outer edges of the material web, i.e, near the two front ends of the roll 1. The exiting web touches the rotary stretcher 2 which is second in the direction of advance of the web only at its peak. Thus, in this operating position, the webs of material remain completely uninfluenced by the pair of rotary stretchers—a separation does not take place. The same thing applies if, starting from this operating position, the support frame 9 were to be turned clockwise. However, if the support frame 9 is turned counterclockwise, this results in the operating positions in which a separation of the partial webs takes place. Such an operating position is shown as an example in the FIGS. 2B, 3B and 4B. In these Figures, for the sake of clarity, merely the outermost edge of the material web pointing towards the observer is drawn in.

As is clarified by comparing the respectively accompanying FIGS. 2A with 2B, 3A with 3B and 4A with 4B, the crown vector A of the first rotary stretcher 1 encloses a 90° angle with respect to the entering web. In the same manner, the exiting web also encloses an angle of 90° with respect to the crown vector B of the second rotary stretcher 2. This is automatically brought about in all three embodiments in that during a horizontal sweep (i.e., turning angularly about a horizontal axis, such as axis 7) of the support frame 9 into a new operating position, the crown vectors 4A and 4B of the two rotary stretchers 1 and 2 are turned in the direction opposite the pivot direction of the support frame 9 sufficiently far that at each angle position of the support frame 9, a well-defined angle position of the crown vector A and B with respect to the stand 10, is set, i.e., such that the 90° condition is assured in each position of the frame 9 at both rotary stretchers or rolls 1 and 2. In order to achieve this, in each embodiment, at least one pair of transmissions is provided, which effects a simultaneous, automatic twisting (i.e., angular turning about the roll axis of rotation) of the deflection lines B1 and B2 with respect to the crown vector A or B of the flexed rolls 1 and 2 during a horizontal sweep of the support frame 9 with respect to the stand 10 such that the transmissions are necessarily operated by means of the sweep movement of the support frame 9. That is to say, when the support frame 9 sweeps, or turns angularly about its axis 7, the crown vectors A, B, of the flexed, or bowed, rolls 1, 2, respectively, are linked so as to also turn angularly about their axes of rotation for an equal amount of angular rotation, but in the opposite direction as the support frame. Therefore, with the examples shown and preferred so far in the drawing, the frame 9 is respectively a part of at least the one pair of transmissions.

With all examples, respectively one transmission, each consisting of the structural components 3, 5 and 8, which are shown as components 3A, 5A, 8A; 3B, 5B, 8B; 3C, 5C, 8C in FIGS. 2A, 2B; 3A, 3B and 4A, 4B, respectively, is arranged between the swivelling axis 7 of the support frame 9 and the axis of rotation 21 of the first rotary stretcher 1. The other transmission consists of the structural components 8, 6 and 4 which are shown in FIGS. 2A, 2B and 8A, 6A and 4A; in FIGS. 3A, 3B as 8B, 6B and 4B; in FIGS. 4A, 4B as 8C, 6C and 4C and is effective between the swivelling axis 7 of the support frame 9 and the axis of rotation 22 of the second rotary stretcher 2. It is also possible to provide a pair of transmissions at each of the two front ends of the roll. However, as a rule, it is sufficient and is shown in the three examples, that the one transmission (3A, 3B, 3C; 5A, 5B, 5C; 8A, 8B, 8C) be provided at the one front end of the roll and the other transmission (8A, 8B, 8C; 6A, 6B, 6C; 4A, 4B, 4C) be provided at the opposite front end. For the sake of clarity, in the example according to FIGS. 2A/B, merely the transmission 8A, 8B 8C; 6A, 6B, 6C, 4A, 4B, 4C, provided at the opposite front end of the roll, is shown. In the case of the remaining two examples, according to FIGS. 3A to 4B, merely the transmission 3A, 3B, 3C; 5A, 5B, 5C; 8A, 8B, 8C, visible when the support frame which is near the observer is omitted, is shown in order to maintain the clarity of the Figures as far as possible. The transmission of the transmission pair which, arranged at the other front end of the roll is executed in the same manner as the pair of transmissions visible in the drawing.

In the example according to the FIGS. 2A/B, at the structural components of the rotary stretcher 1 which are fixed, i.e., not rotatable about the axis of rotation 21 or 22, an adjustment lever 3A or 4A is arranged without rotational play. The one pivot point of each of the adjustment levers 3A or 4A coincides with the axis of rotation 21 or 22. At the other pivot point, respectively, a lug for the pivotable attachment of a steering device or of a pressure/slide rod 5A or 6A is provided. The respectively other end of these pressure/slide rods 5A and 6A is rotatably connected to the lug of another lever 8A. This lever 8A is fixed with respect to the stand 10 and is rotatable with respect to the support frame 9.

This transmission functions in the following manner: If the support frame 9 is turned, for example, starting from the operating position shown in FIG. 2A into the operating position shown in FIG. 2B counterclockwise about the swivelling axis 7, effective between the support frame 9 and the stand 10, then the axes of rotation 21 and 22 of the rotary stretchers 1 and 2 are also displaced counterclockwise with respect to the swivelling axis 7. The paths covered at that time by the axes of rotation 21 or 22 are equal in length, because in the example shown and, in that sense, preferred according to the invention, the swivelling axis 7 is arranged in the middle of the connection line between the axes of rotation 21 and 22. Since the lug of the lever 8A is not displaced during this sweep movement of the frame 9, as mentioned above but, remains stationary with respect to the stand 10, the counterclockwise displacement of the axes of rotation 21 and 22 causes the pressure/slide rods 5A and 6A to turn the adjustment levers 3A and 4A clockwise about the axes of rotation 21 or 22 of the rotary stretchers 1 and 2, i.e., the crown vectors A and B to turn clockwise by the same angle. An appropriate layout of this steering transmission manages to maintain the 90°-condition in each operating position of the separation device. For adjustment purposes, the length of the pressure/slide rods 5A and 6A can be changed. A relatively simple to achieve sweep of the support frame 9 thus effects a necessary synchronous turning of the crown vectors A and B while permanently maintaining the 90°-condition.

With the embodiment according to FIGS. 3A/B, the transmissions of each transmission pair are realized by respectively two wheels 8B and 3B, as well as a belt or a chain 5B, which continuously runs around both transmission wheels. At all angular positions of the support frame 9, the gearwheel 8B is held unturnable with respect to the stand 10. Its axis is coaxially aligned with the swivelling axis 7 of the support frame 9. The gearwheel 3B and gearwheel 4B, not visible in the drawing, at the other front end of the roll is arranged with respect to the crown vector A or B of the first or second rotary stretcher in a position which is fixed with regard to the respecitve axis of rotation 21 and 22. During a sweep of the support frame 9, this transmission arrangement causes the crown vectors A or B of the two rotary stretchers 1 and 2 to be turned in the opposite direction with respect to the stand 10, with the transmission layout again being selected such that the 90°-condition is maintained in all swivel positions of the support frame 9.

In the embodiment according to FIGS. 4A/B, pure toothed gearings are used as gearings of the transmission pair. A transmission wheel 8C, in accordance with the manner in the example according to FIG. 3A/B, is fixed with respect to the stand 10 and is attached coaxially to the swivelling axis 7 of the support frame 9. Also the gearwheel 3C, arranged coaxially to the axis of rotation 21 of the first rotary stretcher, and the gearwheel 4C, not visible in the drawing, at the other front end of the roll, as in the embodiment according to the FIGS. 3A/B, is arranged in a fixed manner with the arc, i.e., the crown vector A or B of the first or second rotary stretcher.

Instead of the belt or the chain 5B in the example according to the FIGS. 3A/B, in the example according to FIGS. 4A/B, there is a toothed wheel 5C, which is rotatably mounted at the free end of a one-armed lever 5D. The levers 5D are attached in a fixed manner at their other end coaxially to the swivelling axis 7 at the support frame 9. In the same way, basically, the transmission wheel 5C may be provided directly at the support frame 9 in a rotatable manner. In each case, the gearwheel 5C engages the gearwheel 8C as well as the gearwheel 3C (and a corresponding gear wheel on the far side of the apparatus, not shown) of the accompanying transmission. Also, in the case of this transmission pair, a pivoting of the support frame 9 about its swivelling axis 7 leads to the point where the arcs, i.e., the crown vectors A and B of the first and second rotary stretcher, turn in opposite direction with respect to the stand 10, where, again, the transmission layout assures that the 90°-condition is maintained in all swivelling positions of the support frame 9.

| List of reference numerals | |
|---|---|
| 1 | roll |
| 2 | roll |
| 3A | adjusting lever |
| 3B | gearwheel |
| 3C | gearwheel |
| 4A | adjusting lever |
| 4B | gearwheel |
| 4C | gearwheel |
| 5A | pressure/slide rod |
| 5B | belt or chain |
| 5C | gearwheel |
| 6A | pressure/slide rod |
| 6B | belt or chain |
| 6C | gearwheel |
| 7 | swivelling axis |
| 8A | lever |
| 8B | gearwheel |
| 8C | gearwheel |
| 9 | supporting frame |
| 10 | stand |
| 21 | axis of rotation |
| 22 | axis of rotation |
| 30 | material webs |
| 30' | partial webs |
| 30" | material webs (lap) rolled as a partial web |
| 31' | partial roll |
| 31" | partial roll |
| 32 | first king roll |
| 33 | second king roll |
| 34 | roll |
| 100 | separating device |
| B1 | deflection line |

-continued

| List of reference numerals | |
|---|---|
| B2 | deflection line |
| A | crown vector |
| B | crown vector |
| G' | spacing gap |
| G" | spacing gap |

I claim:

1. A device for laterally separating a plurality of traveling partial webs which have been slit longitudinally in a web of material, such as paper, to be wound into corresponding web rolls on a winding apparatus, the device having two rolls which are disposed to rotate substantially parallel with one another, the rolls each having a cylindrical surface bowed to form a crown having a crown vector, the crown vectors of the two rolls extending in substantially parallel planes, but extending in opposed directions, such that the partial webs are separated laterally a predetermined distance from one another when the partial webs pass over the bowed surface on one, upstream roll and such distance is maintained when the partial webs pass under the bowed surface of the other, downstream roll, comprising, in combination.

a stand;

a support frame pivotally mounted about an axis in the stand so as to be capable of rotating about the axis parallel to the plane of the traveling web and to be fixed at a predetermined angular position, as desired;

the rolls rotatably mounted in the support frame in spaced, parallel adjacency each roll mounted on one side of the pivot of the support frame:

roll controlling means operatively associated with each roll, the support frame and the stand, the roll controlling means including a first roll turning means mounted on each roll for positioning each roll to selectively position the roll crown vector, the roll controlling means further including a second roll turning means fixedly mounted to the stand relative to the support frame in operative association with the first roll turning means;

the first roll turning means comprises an adjustment lever attached to each roll for angularly turning the corresponding roll about the axis of rotation of the roll;

the second roll turning means includes a stand lever fixedly mounted to the stand about the pivotable axis of the support frame;

the roll controlling means further includes an extendable pressure/slide rod having one end attached to the adjustment lever and the other end attached to the stand lever for each roll;

whereby turning movement of the support frame about the support frame pivot axis causes the extendable pressure/slide rods to move the adjustment lever of each roll to cause the crown vectors of the rolls to turn substantially equally about the axes of roll rotation in a direction opposite to the direction of support frame pivotal movement while remaining parallel to one another at desired crown vector locations.

2. A device for laterally separating a plurality of traveling partial webs which have been slit longitudinally in a web of material, such as paper, to be wound into corresponding web rolls on a winding apparatus, the device having two rolls which are disposed to rotate substantially parallel with one another, the rolls each having a cylindrical surface bowed to form a crown having a crown vector, the crown vectors of the two rolls extending in substantially parallel planes, but extending in opposed directions, such that the partial webs are separated laterally a predetermined distance from one another when the partial webs pass over the bowed surface on one, upstream roll and such distance is maintained when the partial webs ass under the bowed surface of the other, downstream roll, comprising, in combination:

a stand a support frame pivotally mounted about an axis in the stand so as to be capable of rotating about the axis parallel to the plane of the traveling web and to be fixed at a predetermined angular position, as desired;

the rolls rotatably mounted in the support frame in spaced, parallel adjacency, each roll mounted on one side of the pivot of the support frame;

roll controlling means operatively associated with each roll, the support frame and the stand, the roll controlling means including a first roll turning means mounted on each roll for positioning each roll to selectively position the roll crown vector, the roll controlling means further including a second roll turning means fixedly mounted to the stand relative to the support frame in operative association with the first roll turning means;

the first roll turning means comprises a first gear wheel attached to each roll for angularly turning each roll about the axis of rotation of the roll;

the second roll turning means comprises a second gear wheel fixedly mounted to the stand for each first gear wheel and coaxially with the rotational axis of the support frame;

looped means extending between each of the first and second sets of gear wheels for linking said gear wheels such that pivotal movement of the support frame causes the rolls and the associated crown vectors of said rolls to pivot about the axes of rotation of the rolls while the crown vectors remain parallel and positioned at desired locations;

whereby, turning movement of the support frame about the support frame axis selectively moves each roll equally angularly relative to the stand and rotationally about the axis of rotation of each roll in a direction opposite to the direction of the support frame so as to maintain the crown vectors parallel and positioned relative to the traveling webs through the roll control means as desired.

3. A device for laterally separating a plurality of traveling partial webs, as set forth in claim 2, wherein:

the looped means comprises a belt or chain.

4. A device for laterally separating a plurality of traveling partial webs which have been slit longitudinally in a web of material, such as paper, to be wound into corresponding web rolls on a winding apparatus, the device having two rolls which are disposed to rotate substantially parallel with one another, the rolls each having a cylindrical surface bowed surface to form a crown having a crown vector, the crown vectors of the two rolls extending in substantially parallel planes, but extending in opposed directions, such that the partial webs are separated laterally a predetermined distance from one another when the partial webs pass over the bowed surface on one, upstream roll and such distance is maintained when the partial webs pass under the bowed surface of the other, downstream roll, comprising, in combination:

a stand;

a support frame pivotally mounted about an axis in the stand so as to be capable of rotating about the axis parallel to the plane of the traveling web and to be fixed at a predetermined angular position, as desired;

the rolls rotatable mounted in the support frame in spaced, parallel adjacency, each roll mounted on one side of the pivot of the support frame;

roll controlling means operatively associated with each roll, the support frame and the stand, the roll controlling means including a first roll turning means mounted on each roll for positioning each roll to selectively position the roll crown vector, the roll controlling means further including a second roll turning means fixedly mounted to the stand relative to the support frame in operative association with the first roll turning means;

the first roll turning means comprises a first gear wheel attached to each roll to rotate with the roll about the axis of rotation of the roll;

the second roll turning means comprises a second gear wheel for each first gear wheel, each second gear wheel fixedly mounted to the stand concentric about the support frame axis of rotation;

the roll control means further includes a third gear wheel for each first and second gear wheels, each third gear wheel rotatably mounted relative to the support frame to move therewith, the third gear wheel operatively engaging the first and second gear wheels for each roll; p1 whereby turning movement of the support frame about the support frame pivot axis causes the first, second and third gear wheels for each roll to operatively engage to cause the crown vectors to turn substantially equally about the axes of roll rotation while remaining parallel to one another at desired crown vector locations.

5. A device for laterally separating a plurality of traveling partial webs, as set forth in claim 4, wherein;

the roll control means includes a gear wheel lever mounted concentric with the rotational axis of the support frame on the stand, and fixedly on the support frame;

the third gear wheel is mounted to the gear wheel lever so as to continuously engage both the first and second gear wheels as the support frame is rotated.

* * * * *